US005884848A

United States Patent [19]

Crofts et al.

[11] Patent Number: 5,884,848

[45] Date of Patent: Mar. 23, 1999

[54] FUEL INJECTOR WITH PIEZOELECTRIC AND HYDRAULICALLY ACTUATED NEEDLE VALVE

[75] Inventors: John D. Crofts, Edinburgh; George L. Muntean, Columbus, both of Ind.

[73] Assignee: Cummins Engine Company, Inc., Columbus, Ind.

[21] Appl. No.: 853,592

[22] Filed: May 9, 1997

[51] Int. Cl.[6] ..... F02M 61/20

[52] U.S. Cl. ..... 239/533.2; 239/533.4; 239/533.8; 239/533.9; 251/129.06

[58] Field of Search ..... 239/102.1, 102.2, 239/95, 533.2, 533.4, 533.8, 533.9; 251/129.06

[56] References Cited

U.S. PATENT DOCUMENTS

| | | | |
|---|---|---|---|
| 2,959,360 | 11/1960 | Nichols | 239/533 |
| 4,022,166 | 5/1977 | Bart | 123/32 JV |
| 4,394,964 | 7/1983 | Ecomard et al. | 239/90 |
| 4,637,553 | 1/1987 | Kushida et al. | 239/533.4 |
| 4,649,886 | 3/1987 | Igashira et al. | 123/498 |
| 4,728,074 | 3/1988 | Igashira et al. | 251/57 |
| 4,784,102 | 11/1988 | Igashira et al. | 123/447 |
| 4,803,393 | 2/1989 | Takahashi | 310/328 |
| 4,909,440 | 3/1990 | Mitsuyasu et al. | 239/96 |
| 4,943,004 | 7/1990 | Takahashi | 239/95 |
| 5,419,492 | 5/1995 | Gant et al. | 239/88 |
| 5,421,521 | 6/1995 | Gibson et al. | 239/585.4 |
| 5,452,858 | 9/1995 | Tsuzuki et al. | 239/533.8 |
| 5,463,996 | 11/1995 | Maley et al. | 123/446 |
| 5,673,669 | 10/1997 | Maley et al. | 123/446 |
| 5,697,342 | 12/1997 | Anderson et al. | 123/446 |
| 5,720,318 | 2/1998 | Nagarajan et al. | 137/625.64 |

FOREIGN PATENT DOCUMENTS

| | | |
|---|---|---|
| 759420 | 8/1940 | Germany . |
| 450866 | 2/1949 | Italy . |
| 2079369 | 1/1982 | United Kingdom . |
| 2129052 | 5/1984 | United Kingdom . |
| 9306625 | 4/1993 | WIPO . |
| 9419598 | 9/1994 | WIPO . |
| 9610129 | 4/1996 | WIPO . |
| 9637698 | 11/1996 | WIPO . |

*Primary Examiner*—Andres Kashnikow
*Assistant Examiner*—David Deal
*Attorney, Agent, or Firm*—Sixbey, Friedman, Leedom & Ferguson; Charles M. Leedom, Jr.; Tim L. Brackett, Jr.

[57] ABSTRACT

An improved fuel injector for providing precise control over injection timing, quantity and rate shape is provided which includes a piezoelectric actuator for compressing actuating fluid in an actuating fluid circuit which includes a fluid chamber positioned adjacent a needle valve element and fluidically separate from a fuel supply circuit for supplying high pressure fuel for injection. Actuating fluid pressure in the chamber acts on the needle valve element to initiate injection. A fuel pressure balancing device is provided for balancing the fuel pressure forces acting on the needle valve element while the element is in both the closed and open positions thereby permitting the piezoelectric actuator to more precisely and predictably control the rate of movement, and the extent of movement, of the needle valve element.

22 Claims, 3 Drawing Sheets

FUEL INJECTOR WITH PIEZOELECTRIC AND HYDRAULICALLY ACTUATED NEEDLE VALVE

TECHNICAL FIELD

This invention relates to an improved fuel injector which permit effective control over the timing, quantity and injection rate shape of fuel injected while minimizing injector actuator response time.

BACKGROUND OF THE INVENTION

In most fuel supply systems applicable to internal combustion engines, fuel injectors are used to direct fuel pulses into the engine combustion chamber. A commonly used injector is a closed-nozzle injector which includes a nozzle assembly having a spring-biased nozzle valve element positioned adjacent the nozzle orifice for resisting blow back of exhaust gas into the pumping or metering chamber of the injector while allowing fuel to be injected into the cylinder. The nozzle valve element also functions to provide a deliberate, abrupt end to fuel injection thereby preventing a secondary injection which causes unburned hydrocarbons in the exhaust. The nozzle valve is positioned in a nozzle cavity and biased by a nozzle spring to block fuel flow through the nozzle orifices. In many fuel systems, when the pressure of the fuel within the nozzle cavity exceeds the biasing force of the nozzle spring, the nozzle valve element moves outwardly to allow fuel to pass through the nozzle orifices, thus marking the beginning of injection. However, these conventional injectors rely on injector or system components upstream of the nozzle assembly to determine the injection timing, metering and rate shape, and, therefore, may not provide the optimum control over the fuel injection event necessary for certain applications and to achieve certain objectives.

Internal combustion engine designers have increasingly come to realize that substantially improved fuel supply systems are required in order to meet the ever increasing governmental and regulatory requirements of emissions abatement and increased fuel economy. It is well known that the level of emissions generated by the diesel fuel combustion process can be reduced by optimizing the fuel injection timing, metering and injection flow rate for a particular application or set of operating conditions. For example, emissions may be minimized by decreasing the volume of fuel injected during the initial stage of an injection event while permitting a subsequent unrestricted injection flow rate. In other applications, pilot and multiple injections produce the optimal combustion event. As a result, many closed nozzle assemblies have been proposed for enabling more precise control of injection timing, quantity and flow rate throughout engine operation.

One way of more precisely controlling the movement of the needle valve element of a closed nozzle element and, therefore, more precisely controlling the fuel injection event, is to utilize a piezoelectric actuator. U.S. Pat. No. 4,649,886 to Igashira et al. discloses a piezoelectric actuator controlled fuel injector where the amount of fuel delivered by the operation of the injector is determined by the driving voltage applied to the piezoelectric actuator. The actuated piezoelectric actuator acts upon a piston which compresses the fuel inside a pump chamber, wherein the compressed fuel is supplied to an injection valve. The reference further discloses that the injection valve includes a needle valve having a step-shaped portion that includes a small diameter portion under a larger diameter portion. The pressure of the compressed fuel acts upon the stepped portion of the injection valve to overcome forces biasing the valve shut thereby raising the needle valve to open the nozzle of the injector. However, the injection fuel, metered by a check valve, is used lift the needle valve to the open position and this metered fuel is then injected from the nozzle. Therefore, the opening of the needle valve element and, therefore, the timing of the injection event is undesirably dependent on the pressure of the fuel to be injected. Moreover, it has been found that the piezoelectric actuators are incapable of effectively and efficiently generating the high fuel pressures desired in many fuel system applications.

U.S. Pat. No. 4,728,074, No. 4,784,102, No. 4,909,440 and No. 5,452,858 and PCT Publication No. WO 96/37698 all disclose fuel injectors which utilize a piezoelectric actuator to relieve pressure in a chamber so as to cause a needle valve element to open. For example, U.S. Pat. No. 5,452,858 discloses the use of a piezoelectric actuator to drive a piston which changes the pressure of a working fluid, separate from the injected fuel, in a pressure chamber to control the opening and closing of a needle valve. However, the injectors disclosed in each of these references disclose that the piezoelectric actuator is energized to expand a pressure chamber located adjacent to the injector needle, thus decreasing the pressure within the pressure chamber, in order to relieve the forces biasing the injector needle closed. Also, this injector is not fuel pressure balanced in the closed position and thus the piezoelectric stack be maintained in the expanded state to maintain the hydraulic pressure in the pressure chamber at a high level to hold the element in the closed position.

PCT Patent Publications WO 93/06625 and WO 94/19598 each disclose fuel injection valves using a piezoelectric actuator for moving a piston to controllably vary the pressure of fluid in a hydraulic chamber which is fluidically separate from a fuel supply. The hydraulic chamber is positioned at one end of a needle valve element biased by a spring toward the piezoelectric actuator into a closed position. Pressurization of the fluid in the hydraulic chamber forces the needle valve element into an open position to begin injection of fuel supplied to a nozzle cavity. However, each of these injection systems requires the needle valve to be an outwardly opening valve. Also, the needle valve elements do not appear to be fuel pressure balanced in both positions.

Consequently, there is a need for an improved closed nozzle fuel injector assembly operated by a piezoelectric actuator which is capable of effectively, precisely and selectively controlling the rate and degree of opening of a needle valve element.

SUMMARY OF THE INVENTION

Thus, it is an object of the present invention to provide a fuel injector which overcomes the disadvantages of the prior art and to provide fuel injector capable of precisely and reliably controlling the timing, quantity and rate of fuel injection.

It is another object of the present invention to provide a closed nozzle fuel injector which permits precise, variable control over the movement a needle valve element.

It is yet another object of the present invention to provide a piezoelectric actuated closed nozzle fuel injector which minimizes the energy required to operate the actuator.

Another object of the present invention is to provide a piezoelectric actuated closed nozzle fuel injector assembly which balances the fuel pressure forces acting on the needle valve element.

Still another object of the present invention is to provide a piezoelectric actuated closed nozzle fuel injector assembly which effectively controls the opening and closing velocities of the needle valve element to limit nozzle and needle stresses.

Yet another object of the present invention is to provide a piezoelectric actuated closed nozzle fuel injector capable of controlling injection timing, quantity and flow rate independent of fuel pressure.

A still further object of the present invention is to provide a piezoelectric actuated closed nozzle fuel injector capable of variably controlling the movement of the needle valve element to achieve injection rate shaping.

A further object of the present invention is to provide a piezoelectric actuated closed nozzle fuel injector which permits optimum control over the movement of the needle valve element at very high fuel injection pressures.

These and other objects of the present invention are achieved by providing a fuel injector for injecting high pressure fuel into a combustion chamber of an internal combustion engine, comprising an injector body containing an injector cavity, an injector orifice communicating with one end of the injector cavity and a fuel supply circuit for supplying fuel for injection through the injector orifice. A needle valve element is positioned in the injector cavity and includes a first end positioned adjacent the injector orifice and a second end positioned opposite the first end. The needle valve element is operable to be placed in an open position in which fuel may flow from the fuel supply circuit through the injector orifice into the combustion chamber and a closed position in which fuel flow through the injector orifice is blocked. A needle valve actuating device is provided for moving the needle valve element between the open and closed positions, and includes a piezoelectric actuator capable of contraction and expansion. The needle valve actuating device also includes an actuating piston associated with the piezoelectric actuator for advancing and retracting along with the piezoelectric actuator. In addition, the actuating device includes an actuating fluid circuit fluidically separate from the fuel supply circuit. The actuating fluid circuit may include a first or outer actuating fluid chamber positioned adjacent one end of the actuator piston and a second or inner actuating fluid chamber positioned adjacent the needle valve element between the first and second ends of the needle valve element. The actuating fluid circuit also includes a fluid passage connecting the first and second actuating fluid chambers. Expansion of the piezoelectric actuator causes advancement of the actuator piston and pressurization of actuating fluid in the actuating chambers. The actuating fluid pressure in the second actuating fluid chamber creates actuating fluid pressure forces on the needle valve element to cause movement of the needle valve element from the closed toward the open position. The needle valve element moves toward the piezoelectric actuator when moving toward the open position and thus this arrangement is effectively utilized with a closed nozzle fuel injector.

Movement of the needle valve element from the closed to the open position and from the open to the closed position defines an injection event during which fuel may flow through the injector orifice into the combustion chamber. The fuel injector may include a fuel pressure balancing device for balancing fuel pressure forces acting on the needle valve element. The fuel pressure balancing device includes a balancing cavity formed in the needle valve element for receiving supply fuel, and pressure balancing surfaces formed on the needle valve element and positioned in the balancing cavity. The pressure balancing surfaces have an effective cross sectional area for balancing the fuel pressure biasing forces acting on the needle valve element during an injection event. The balancing cavity is positioned to be in fluidic communication with the fuel supply circuit when the needle valve element is in the open position. Moreover, fluidic communication between the balancing cavity and the fuel supply circuit is blocked when the needle valve element is in the closed position. The needle valve element may be designed to block fuel flow into the balancing cavity when in the closed position. The fuel supply circuit includes a needle cavity positioned adjacent the injector orifices while the fuel pressure balancing device further includes a closed position balancing feature for balancing fuel pressure forces on the needle valve element when the element is in the closed position. The closed position balancing feature includes a constant diameter section of the needle valve element positioned in the needle cavity wherein the constant diameter section is the only portion of the needle valve element exposed to supply fuel pressure in the needle cavity.

The fuel pressure balancing device may include a balancing fluid circuit including a passage formed integrally in the needle valve element for delivering fuel to the balancing cavity. The fuel supply circuit may also include a needle cavity positioned adjacent the injector orifice wherein the balancing passage fluidically connects the balancing cavity and the needle cavity. The balancing passage extends axially along the needle valve element and the injector body includes a valve seat for engagement by the needle valve element when the element is in the closed position so as to block fuel flow through the injector orifice and injector actuating fluid circuit. The inner or second actuating fluid chamber may be positioned axially along the injector between the balancing cavity and the needle cavity.

The fuel pressure balancing device may include a balancing piston telescopingly positioned in the balancing cavity. The balancing piston is preferably sized to create at least a partial fluid seal between an outer surface of the balancing piston and an inner wall of the needle valve element forming the balancing cavity so as to at least partially fluidically seal an outer end of the balancing cavity.

DETAILED DESCRIPTION OF THE PREFERRED EMBODIMENT

Figure 1:
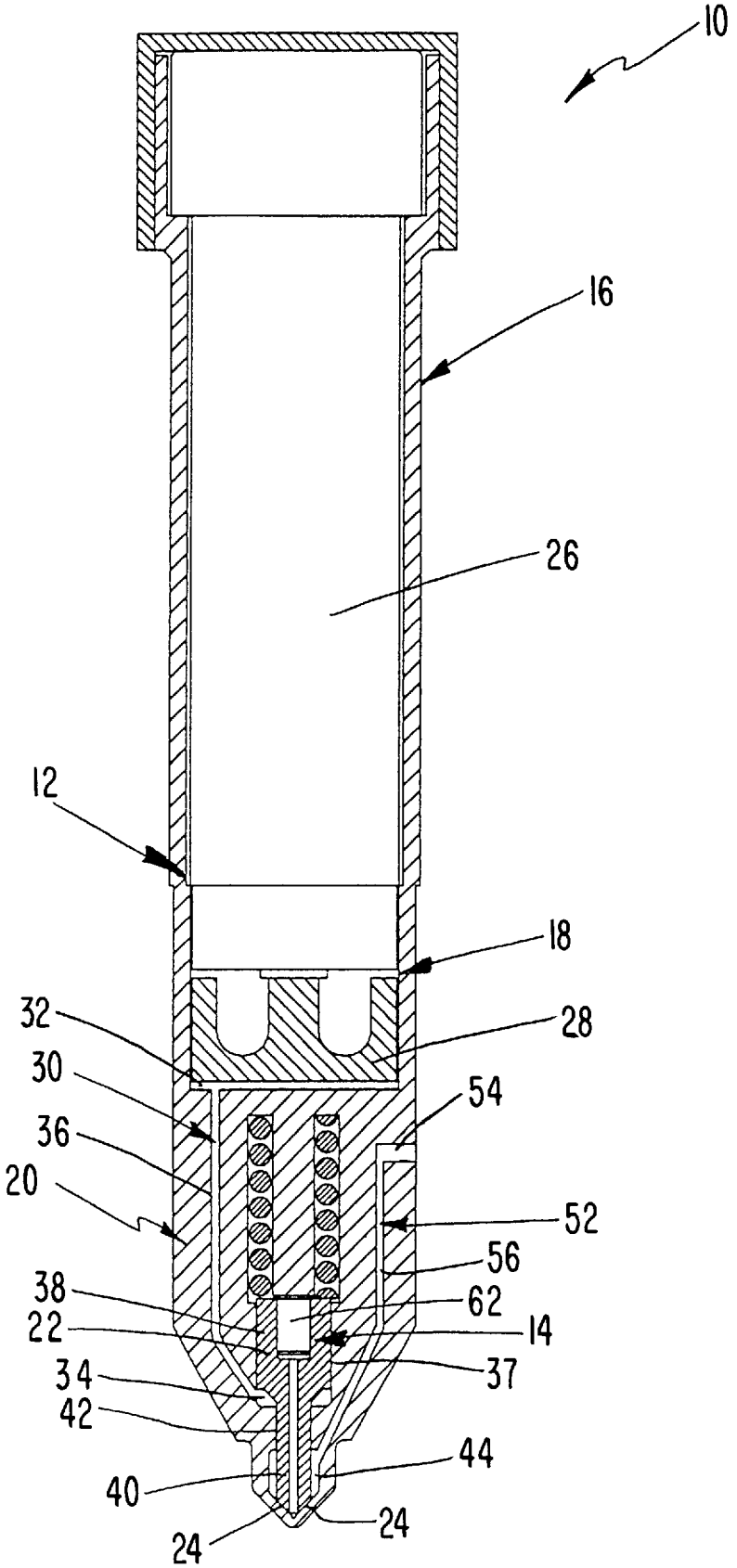
FIG. 1 is a cross sectional schematic of the fuel injector of the present invention incorporating the needle valve actuating device and fuel pressure balancing device of the present invention.

Referring to FIG. 1, there is shown the fuel injector of the present invention indicated generally at 10 which includes the novel and improved needle valve actuating device 12 of the present invention and a fuel pressure balancing feature indicated at 14. Fuel injector 10 is comprised of an injector body 16 having a generally elongated, cylindrical shape which forms an injector cavity 18. The inner portion of fuel injector body 16 includes a closed nozzle assembly, indicated generally at 20, which includes a needle valve element 22 reciprocally mounted for opening and closing injector orifices 24 formed in body 16 thereby controlling the flow of injection fuel into an engine combustion chamber (not shown).

Needle valve actuating device 12 includes a piezoelectric actuator 26 positioned in the upper portion of injector cavity 18 and an actuating piston 28 positioned adjacent to, and operatively connected to, the inner end of piezoelectric actuator 26. Piezoelectric actuator 26 may comprise a columnar laminated body of thin disk-shaped elements each having a piezoelectric effect. When a voltage, i.e. +150 volts, is applied to each element, the element expands along the axial direction of the column. Conversely, when a voltage of −150 volts is applied to each element, the element contracts so that the inner end of piezoelectric actuator 26 moves away from closed nozzle assembly 20. Piezoelectric actuator 26 may include any type or design of piezoelectric actuator capable of actuating needle valve element 22 as described hereinbelow. The expansion/contraction of piezoelectric actuator 26 is directly transmitted to actuating piston 28, thereby causing piston 28 to reciprocate.

Needle valve actuating device 12 also includes an actuating fluid circuit 30 comprised of a first or outer actuating fluid chamber 32 formed in actuator cavity 18 adjacent the inner end of actuating piston 28. Piston 28 slides within cavity 18 so as to expand/contract the volume of outer actuating fluid chamber 32. Actuating fluid circuit 30 also includes a second or inner actuating fluid chamber 34 formed in one end of an outer bore 37 shaped to receive needle valve element 22. Inner actuating fluid chamber 34 extends annularly around needle valve element 22 and is connected to outer actuating fluid chamber 32 by a fluid passage 36 extending through injector body 16.

Figure 2:
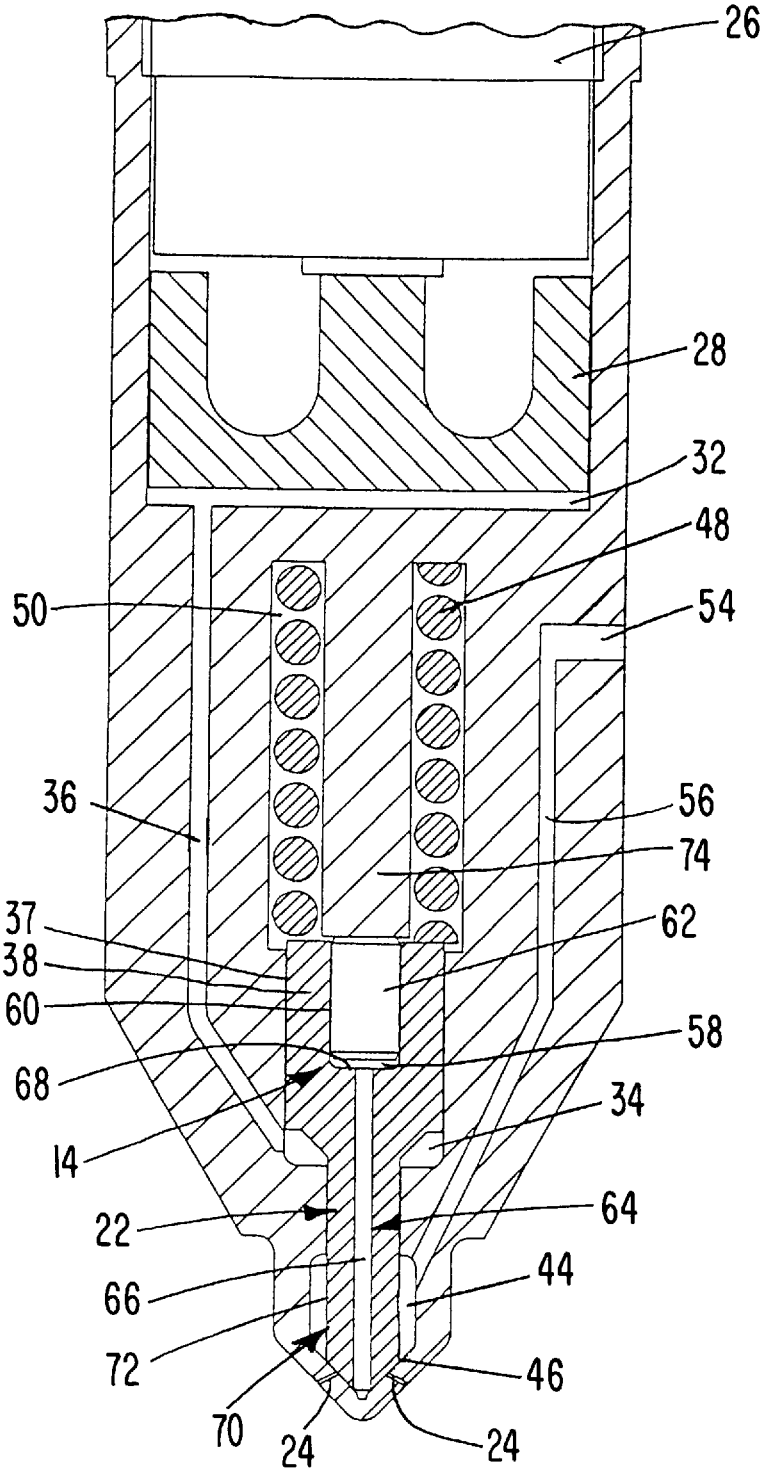
FIG. 2 is a partial cross sectional view of the lower portion of the injector of FIG. 1 showing the nozzle valve element in the closed position.

Needle valve element 22 includes a large outer portion 38 slidably positioned in outer bore 37 and a small inner portion 40 integrally formed with outer portion 38 and extending through an inner bore 42 formed in injector body 16. A needle cavity 44 is provided at the inner end of injector cavity 18 adjacent injector orifices 24. Needle valve element 22 extends through needle cavity 44 for engagement with a valve seat 46 formed on the inner surface of injector body 16 when needle valve element 22 is in the closed position. Needle valve element 22 is biased toward the closed position as shown in FIG. 2 by a bias spring 48 positioned in a spring cavity 50 formed in injector body 16 between outer actuating fluid chamber 32 and the outer end of needle valve element 22.

A fuel supply circuit 52 includes a fuel supply port 54 formed in body 16, needle cavity 44 and a supply passage 56 formed in body 16 for fluidically connecting port 54 and needle cavity 44. Port 54 is supplied with high pressure fuel from any conventional fuel system capable of delivering a supply of fuel pressurized to a desired level for injection, i.e. such as a conventional high pressure common rail system or a system capable of cyclically delivering high pressure fuel to supply circuit 52. Also, it should be noted that the inner portion of fuel injector body 16 within which actuating fluid circuit 30 and fuel supply circuit 52 are formed is shown in schematic form only. A practical form of the injector would necessarily require the inner portion of the injector body 16 to be formed in at least two separate pieces held together in a compressive relationship by, for example, a retainer such as disclosed in U.S. Pat. No. 4,022,166, the contents of which is hereby incorporated by reference. Specifically, it is desirable to form outer bore 37 in one injector housing structure and inner bore 42 in a separate structure to ensure smooth reciprocation of needle valve element 22.

Figure 3:
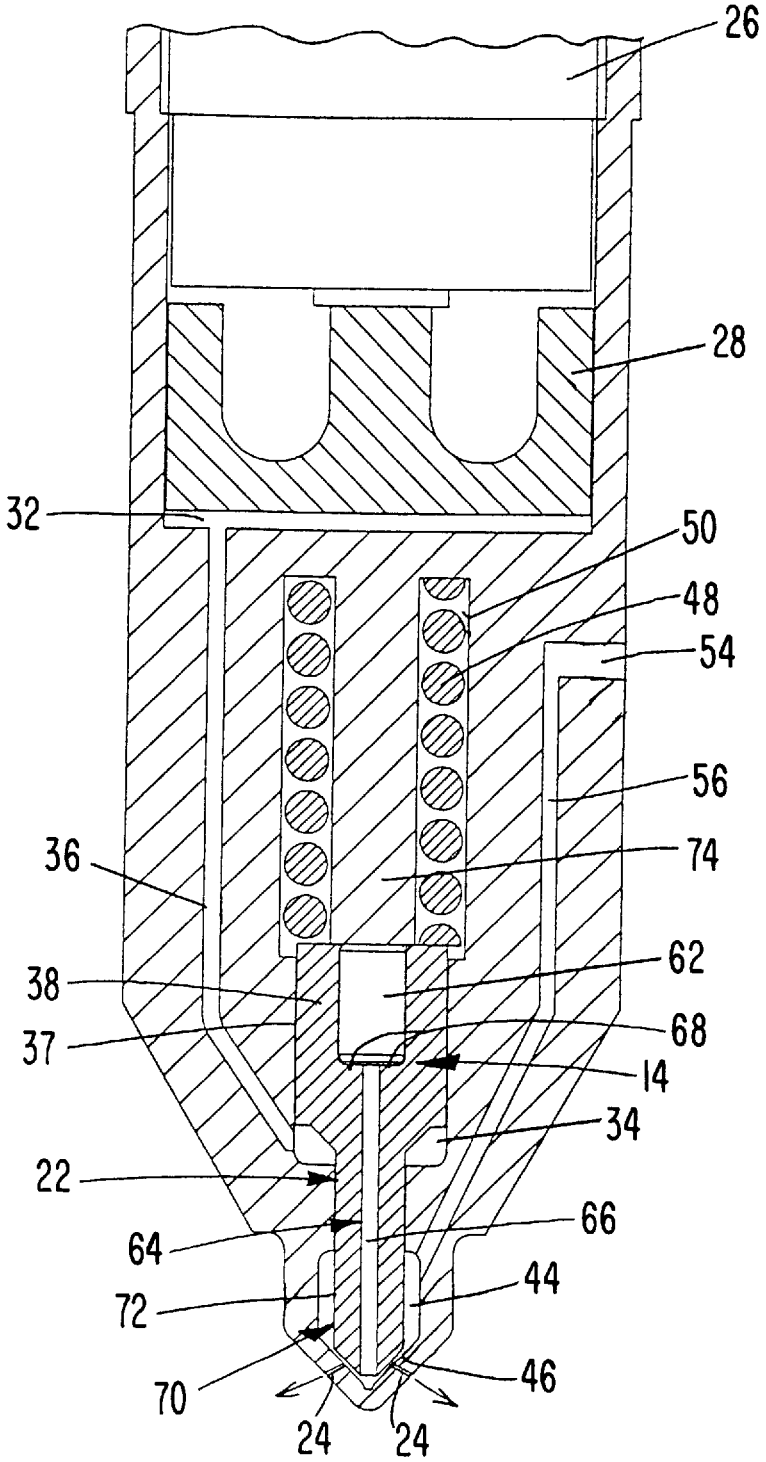
FIG. 3 is a partial cross sectional view of the lower portion of the injector of FIG. 1 showing the needle valve element in the open position.

The fuel pressure balancing device/feature indicated generally at 14 serves to balance fuel pressure forces acting on needle valve element 22 substantially the entire time needle valve element 22 is in both the closed (FIG. 2) and the open (FIG. 3) positions. Fuel pressure balancing device 14 includes a balancing cavity 58 formed in the inner end of a piston bore 60 formed in the outer end of needle valve element 22 adjacent spring cavity 50. Fuel pressure balancing device 14 also includes a balancing piston 62 positioned in piston bore 60 so as to form balancing cavity 58, and a balancing fluid circuit 64 for permitting fluidic communication between balancing cavity 58 and needle cavity 44 when needle valve element 22 is in the open position as shown in FIG. 3. Needle valve element 22 may be opened until the outer end of element 22 abuts a center stop 74 positioned within the inner radial extent of bias spring 48. Center stop 74 also supports the outer end of balancing piston 62. When needle valve element 22 is in the open position, fuel in needle cavity 44 flows through the gap formed between the inner end of needle valve element 22 and valve seat 46 and through integral passage 66 into balancing cavity 58. Fuel acting on the inner end of needle valve element 22 adjacent valve seat 46 tends to move needle valve element 22 toward an open position. Meanwhile, fuel present in balancing cavity 58 acts on pressure balancing surfaces 68 to create pressure forces tending to move needle valve element 22 toward its closed position. Fuel pressure balancing is achieved by forming pressure balancing surfaces 68 with an effective cross sectional area necessary to generate pressure forces of a magnitude equivalent to the pressure forces generated on the inner end of needle valve element 22. Thus, the pressure forces acting on pressure balancing surfaces 68 which tend to bias the needle valve element 22 toward the closed position substantially counteract the fuel pressure forces acting on the inner end of needle valve element 22 which tend to bias the needle valve element 22 toward an open position, thereby substantially balancing the fuel pressure forces on needle valve element 22 when in the open position. For example, assuming that the fuel pressure in balancing cavity 58 reaches the same pressure during an injection event as the pressure of the fuel acting on the inner end of needle valve element 22, pressure balancing can be achieved by providing piston bore 60 with a diameter equal to the outer diameter of small inner portion 40 of needle valve element 22, assuming integral passage 66 has the same diameter at each end.

Fuel pressure balancing device 14 also includes a closed position pressure balancing feature 70 for balancing fuel pressure forces acting on needle valve element 22 when the element is in the closed position. Closed position pressure balancing feature 70 includes a constant diameter section 72 formed on inner portion 40 of needle valve element 22. Constant diameter section 72 extends out of inner bore 42 through needle cavity 44 and is positioned immediately adjacent valve seat 46 when needle valve element 22 is in the closed position. As a result, needle valve element 22 does not include any pressure surfaces tending to bias element 22 in either direction when the element is in the closed position as shown in FIG. 2. Thus, fuel pressure balancing device 14, including closed position pressure balancing feature 70, permits optimum control of the movement of needle valve element 22 by needle valve actuating device 12 thereby enabling precise, variable control of fuel injection timing, quantity and flow rate shape as discussed more fully hereinbelow.

During operation, prior to the beginning of an injection event, needle valve element 22 is positioned in the closed position as shown in FIG. 2 and piezoelectric actuator 26 is de-energized into a contracted state. Bias spring 48 maintains needle valve element 22 against valve seat 46 in the closed position without any fuel pressure induced biasing affect due to the closed pressure balancing feature 70. Balance piston 62 may be sized relative to piston bore 60 so as to create a partial fluid seal at the joint which allows the fuel pressure in balancing cavity 58 to dissipate through the clearance gap into spring cavity 50 between injection events. Spring cavity 50 is preferably connected to a drain via a drain passage (not shown) formed in injector body 16. Thus, the fuel pressure in balancing cavity 58 would be minimal and any pressure biasing forces acting on pressure balancing surfaces 68 would be negligible. On the other hand, balance piston 62 and piston bore 60 are designed with relative diameters so that the partial fluid seal effectively prevents leakage during the high flow/high pressure conditions during an injection event. This ability of the partial fluid seal to provide adequate leakage through the seal joint may be particularly beneficial when using a valve-covered orifice (VCO) nozzle assembly design wherein the valve seat surrounds injector orifices 24 reducing the area on the end of needle valve element 22 which is exposed to fuel when needle valve element 22 is in the closed position. However, the need to ensure leakage through the joint between piston bore 60 and balancing piston 62 may be less significant in nozzle designs wherein valve seat 46 is only an annular line of contact between needle valve element 22 and injector body 16 outward from injector orifice 24. In this design, the fuel positioned between the outer end of needle valve element 22 would be in fluidic communication with the fuel in balancing cavity 58 when needle valve element 22 is in the closed position. Therefore, the pressure forces acting on the inner end of needle valve element 22 would counteract any fuel pressure forces acting on pressure balancing surfaces 68 and balancing cavity 58. The contraction of piezoelectric actuator 26 reduces the pressure in outer actuating fluid chamber 32 and inner actuating fluid chamber 34 to a minimal level so that the pressure forces acting against needle valve element 22 in inner actuating fluid chamber 34 which tend to move needle valve element 22 toward an open position are much less than the bias force of bias spring 48.

At predetermined time during engine operation, a voltage, i.e. +150 volts, is applied to piezoelectric actuator 26 causing actuator 26 to expand thereby moving actuating piston 28 inwardly toward outer actuating fluid chamber 32. As a result, actuating fluid in outer actuating fluid chamber 32 is compressed thereby pressurizing the fluid in inner actuating fluid chamber 34 via fluid passage 36. Although piezoelectric actuator 26 moves actuating piston 28 a very small amount, the relative diameters of actuating piston 28 and the outer portion 38 of needle valve element 22 creates substantial amplification of the motion imparted to needle valve element 22. In other words, since actuating piston 28 is much larger relative to needle valve element 22, a small amount of movement of actuating piston 28 delivers or pumps a relatively large amount of actuating fluid from outer actuating fluid chamber 32 to inner actuating fluid chamber 34 in comparison to the volume of actuating fluid chamber 34. When the pressure in inner actuating fluid chamber 34 rises to a level creating pressure forces acting on needle valve element 22 in needle cavity 44 sufficient to overcome the bias force of bias spring 48, needle valve 20 will begin to lift. The rate of movement of needle valve element 22 from the closed position, as shown in FIG. 2, to an open position, as shown in FIG. 3, will be dependent on the rate of pressure increase in inner actuating fluid chamber 34 which is proportional to the voltage applied to piezoelectric actuator 26. Moreover, the extent of the opening of needle valve element 22, i.e. the maximum open position, may also be controlled by controlling the voltage applied to piezoelectric actuator 26. Thus, the movement of needle valve element 22 can be easily controlled by controlling the voltage applied to piezoelectric actuator 26 thereby ultimately effectively controlling fuel injection.

Moreover, the fuel pressure balancing device 14 of the present invention optimizes the degree of control of movement of needle valve element 22 while minimizing the energy required, i.e. voltage, necessary to achieve the control of the movement. By balancing the fuel pressure forces acting on needle valve element 22 when the element is in both the closed and open positions, fuel pressure balancing device 14 causes the pressure in inner actuating fluid chamber 34 to be the only significant factor determining the rate of movement of needle valve element 22 and the position of needle valve element 22 at any given time. Thus, piezoelectric actuator 26 can be used to more precisely control the movement of needle valve element 22 by controlling the fluid pressure in inner actuating fluid chamber 34.

When needle valve element 22 begins to move toward the open position as shown in FIG. 3, fuel in needle cavity 44 will flow through injector orifices 24 into the combustion chamber and through integral passage 66 into balancing cavity 58. Thus, the fuel pressure forces acting on the inner end of needle valve element 22 which tend to open the element, are balanced by the fuel pressure forces acting on pressure balancing surfaces 68 in balancing cavity 58 which tend to move needle valve element 22 toward the closed position. Piezoelectric actuator 26 can then be operated to effectively control the increase in the fuel pressure in inner actuating fluid chamber 34 to achieve the desired flow rate through injector orifices 24. The injection flow rate through injector orifices 24 during an injection event will primarily depend upon the rate of opening of needle valve element 22. The greater the opening rate of needle valve element 22, the greater the increase in the injection flow rate, while a slower movement rate of the needle will result in a slower injection flow rate. Therefore, the present invention permits the injection flow rate to be precisely shaped to achieve optimum combustion in the engine cylinder for a given set of engine conditions thereby minimizing emissions and maximizing fuel efficiency.

Upon receiving a signal marking the end of the injection event, piezoelectric actuator 26 contracts causing actuating piston 28 to move outwardly enlarging outer actuating fluid chamber 32 thereby depressurizing inner actuating fluid chamber 34. The bias force of bias spring 48 will then return needle valve element 22 to its closed position.

The fuel injector assembly of the present invention results in many advantages over the conventional piezoelectric actuated closed nozzle fuel injector assembly. For example, the present assembly permits a piezoelectric actuator 26 to more precisely control the movement of needle valve element 22 between the open and closed positions by substantially balancing fuel pressure forces on needle valve element 22 while in both the closed and open positions. Without the affect of fuel pressure forces acting on needle valve element 22, the proportional control offered by piezoelectric actuator 26 can be used to precisely control the pressure in inner actuating fluid chamber 34 and thus accurately control both the rate of movement, and the degree of movement, of needle valve element 22. As a result, the desired fuel injection timing, quantity and rate shape can be precisely and reliably achieved. In addition, this high degree of control over the movement of needle valve element 22 permits effective control over the opening and closing velocities of the needle valve element thereby permitting the impact forces to be reduced and thus the stresses in the injector body and needle element to be minimized. In addition, the present fuel injector assembly permits the injection timing, quantity and flow rate to be controlled completely independently of fuel pressure delivered to the assembly thereby permitting the injection fuel pressure to be controlled and varied by an upstream fuel system without affecting the timing of injection.

INDUSTRIAL APPLICABILITY

While the piezoelectric actuated closed nozzle fuel injector assembly of the present invention is most useful in a compression ignition internal combustion engine, it can be used in any combustion engine of any vehicle or industrial equipment in which accurate control and variation of the timing of injection, the metering of the injection quantity and the rate shape of the injection fuel, is essential.

We claim:

1. A fuel injector for injecting high pressure fuel into a combustion chamber of an internal combustion engine, comprising:

an injector body containing an injector cavity, an injector orifice communicating with one end of said injector cavity and a fuel supply circuit for supplying fuel for injection through said injector orifice;

a needle valve element positioned in said injector cavity and including a first end positioned adjacent said injector orifice and a second end positioned opposite said first end, said needle valve element operable to be placed in an open position in which fuel may flow from said fuel supply circuit through said injector orifice into the combustion chamber and a closed position in which fuel flow through said injector orifice is blocked;

a needle valve actuating means for moving said nozzle valve element between said open position and said closed positions, said needle valve actuating means including a piezoelectric actuator capable of contraction and expansion, an actuating piston associated with said piezoelectric actuator for advancing and retracting along with said piezoelectric actuator, and an actuating fluid circuit fluidically separate from said fuel supply circuit, said actuating fluid circuit including a first actuating fluid chamber positioned adjacent one end of said actuator piston, a second actuating fluid chamber positioned adjacent said needle valve element between said first and second ends, and a fluid passage connecting said first and said second actuating fluid chambers, wherein expansion of said piezoelectric actuator causes advancement of said actuator piston and pressurization of actuating fluid in said first and said second actuating fluid chambers, said actuating fluid pressure in said second actuating fluid chamber creating actuating fluid pressure forces acting on said needle valve element to cause movement of said needle valve element from said closed position toward said open position, wherein said needle valve element moves toward said piezoelectric actuator when moving toward said open position.

2. The injector of claim 1, further including a fuel pressure balancing means for substantially balancing fuel pressure forces acting on said needle valve element while said needle valve element is in both said open and said closed positions.

3. The injector of claim 2, wherein said fuel pressure balancing means includes a balancing cavity formed in said needle valve element for receiving supply fuel and pressure balancing surfaces formed on said needle valve element and positioned in said balancing cavity, said balancing surfaces having an effective cross-sectional area for balancing the fuel pressure biasing forces acting on said needle valve element during an injection event.

4. The injector of claim 3, wherein said balancing cavity is in fluidic communication with said fuel supply circuit when said needle valve element is in said open position and wherein fluidic communication between said balancing cavity and said fuel supply is blocked when said needle valve element is in said closed position.

5. The injector of claim 4, wherein said needle valve element blocks fuel flow into said balancing cavity when in said closed position.

6. The injector of claim 3, wherein said fuel supply circuit includes a needle cavity positioned adjacent said injector orifice, said second actuating fluid chamber being positioned axially along the injector between said balancing cavity and said needle cavity.

7. The injector of claim 3, wherein said fuel pressure balancing means includes a balancing piston telescopingly positioned in said balancing cavity.

8. The injector of claim 7, wherein said balancing piston is sized to create at least a partial fluid seal between an outer surface of said balancing piston and an inner wall of said needle valve element forming said balancing cavity so as to fluidically seal an outer end of said balancing cavity.

9. The injector of claim 2, wherein said fuel pressure balancing means includes a balancing fluid circuit including a passage formed integrally in said needle valve element for delivering fuel to said balancing cavity.

10. The injector of claim 9, wherein said fuel supply circuit includes a needle cavity positioned adjacent said injector orifice, said passage fluidically connecting said balancing cavity and said needle cavity.

11. The injector of claim 10, wherein said passage extends axially along said needle valve element, said injector body including a valve seat for engagement by said needle valve element when said needle valve element is in said closed position so as to block fuel flow through both said injector orifice and said injector actuating fluid circuit.

12. A fuel injector for injecting high pressure fuel into a combustion chamber of an internal combustion engine, comprising:

an injector body containing an injector cavity, an injector orifice communicating with one end of said injector cavity and a fuel supply circuit for supplying fuel for injection through said injector orifice;

a needle valve element positioned in said injector cavity adjacent said injector orifice, said needle valve element operable to be placed in an open position in which fuel may flow from said fuel transfer circuit through said injector orifice into the combustion chamber and a closed position in which fuel flow through said injector orifice is blocked, movement of said needle valve element from said closed position to said open position and from said open position to said closed position defining an injection event during which fuel may flow through said injector orifice into the combustion chamber;

a needle valve actuating means for moving said needle valve element between said open position and said closed positions, said needle valve actuating means including a piezoelectric actuator capable of contraction and expansion, an actuator piston associated with said piezoelectric actuator for advancing and retracting along with said piezoelectric actuator, and an actuating fluid circuit fluidically separate from said fuel supply circuit, said actuating fluid circuit including an inner actuating fluid chamber positioned adjacent said needle valve element, wherein expansion of said piezoelectric actuator causes advancement of said actuator piston and pressurization of actuating fluid in said inner actuating fluid chamber, said actuating fluid pressure in said inner actuating fluid chamber creating actuating fluid pressure forces acting on said needle valve element to cause movement of said needle valve element from said closed position toward said open position; and a fuel pressure balancing means for balancing fuel pressure forces acting on said needle valve element, said fuel pressure balancing means including a balancing cavity formed in said needle valve element for receiving supply fuel and pressure balancing surfaces formed on said needle valve element and positioned in said balancing cavity, said balancing surfaces having an effective cross-sectional area for balancing the fuel pressure biasing forces acting on said needle valve element during an injection event.

13. The injector of claim 12, wherein said balancing cavity is in fluidic communication with said fuel supply circuit when said needle valve element is in said open position and wherein fluidic communication between said balancing cavity and said fuel supply circuit is blocked when said needle valve element is in said closed position.

14. The injector of claim 13, wherein said needle valve element blocks fuel flow into said balancing cavity when in said closed position.

15. The injector of claim 14, wherein said fuel supply circuit includes a needle cavity positioned adjacent said injector orifices, said fuel pressure balancing means further including a closed position balancing means for balancing fuel pressure forces on said needle valve element when said needle valve element is in said closed position, said closed position balancing means including a constant diameter section of said needle valve element positioned in said needle cavity, said constant diameter section being the only portion of said needle valve element exposed to said supply fuel pressure in said needle cavity.

16. The injector of claim 12, wherein said fuel pressure balancing means includes a balancing fluid circuit including a passage formed integrally in said needle valve element for delivering fuel to said balancing cavity.

17. The injector of claim 16, wherein said fuel supply circuit includes a needle cavity positioned adjacent said injector orifice, said passage fluidically connecting said balancing cavity and said needle cavity.

18. The injector of claim 17, wherein said passage extends axially along said needle valve element, said injector body including a valve seat for engagement by said needle valve element when said needle valve element is in said closed position so as to block fuel flow through both said injector orifice and said injector actuating fluid circuit.

19. The injector of claim 12, wherein said fuel supply circuit includes a needle cavity positioned adjacent said injector orifice, said inner actuating fluid chamber being positioned axially along the injector between said balancing cavity and said needle cavity.

20. The injector of claim 12, wherein said fuel pressure balancing means includes a balancing piston telescopingly positioned in said balancing cavity.

21. The injector of claim 20, wherein said balancing piston is sized to create at least a partial fluid seal between an outer surface of said balancing piston and an inner wall of said needle valve element forming said balancing cavity so as to fluidically seal an outer end of said balancing cavity.

22. The injector of claim 12, wherein said actuating fluid circuit further includes an outer actuating fluid chamber positioned adjacent one end of said actuating piston and a fluid passage connecting said inner and said outer actuating fluid chambers, said needle valve element moving toward said piezoelectric actuator when moving toward said open position.

* * * * *